US008631602B2

(12) United States Patent
Chupp

(10) Patent No.: US 8,631,602 B2
(45) Date of Patent: Jan. 21, 2014

(54) NON-INVASIVE ACCESSORY MOUNT FOR A FIREARM

(76) Inventor: Todd Chupp, Jacksonville, FL (US)

( * ) Notice: Subject to any disclaimer, the term of this patent is extended or adjusted under 35 U.S.C. 154(b) by 10 days.

(21) Appl. No.: 12/987,454

(22) Filed: Jan. 10, 2011

(65) Prior Publication Data

US 2011/0167704 A1 Jul. 14, 2011

Related U.S. Application Data

(60) Provisional application No. 61/335,539, filed on Jan. 8, 2010.

(51) Int. Cl.
*F41A 15/00* (2006.01)

(52) U.S. Cl.
USPC ..... 42/90; 42/71.02

(58) Field of Classification Search
USPC ..... 42/71.02, 90
See application file for complete search history.

(56) References Cited

U.S. PATENT DOCUMENTS

| | | | | | |
|---|---|---|---|---|---|
| 1,516,972 | A * | 11/1924 | Kramer | 89/145 |
| 4,127,056 | A * | 11/1978 | Kart | 89/128 |
| 4,691,614 | A * | 9/1987 | Leffel et al. | 89/14.3 |
| 4,777,754 | A * | 10/1988 | Reynolds, Jr. | 42/117 |
| D328,632 | S * | 8/1992 | Bigwood | D22/108 |
| 5,293,708 | A * | 3/1994 | Strayer et al. | 42/75.03 |
| 5,501,135 | A * | 3/1996 | Beretta | 89/196 |
| 6,257,116 | B1 * | 7/2001 | Moczijdlower et al. | 89/155 |
| 6,393,752 | B1 * | 5/2002 | Oliver et al. | 42/114 |
| 6,477,802 | B2 * | 11/2002 | Baer, Sr. | 42/97 |
| 6,869,285 | B1 * | 3/2005 | Jones, II | 434/16 |
| 7,047,686 | B2 * | 5/2006 | Zimmermann | 42/75.1 |
| 7,076,908 | B2 | 7/2006 | Kim | |
| 7,117,627 | B2 | 10/2006 | Woodmansee, III et al. | |
| 7,194,836 | B1 * | 3/2007 | Urban | 42/60 |
| 7,325,352 | B2 * | 2/2008 | Matthews et al. | 42/85 |
| 7,334,365 | B2 | 2/2008 | Kim | |
| 7,334,366 | B2 * | 2/2008 | La France | 42/146 |
| 7,353,630 | B2 * | 4/2008 | McGarry | 42/16 |
| 7,395,627 | B2 | 7/2008 | La France et al. | |
| 7,493,845 | B2 * | 2/2009 | Mantas | 89/42.01 |
| 7,578,090 | B1 * | 8/2009 | Romaszka | 42/96 |
| 2005/0257413 | A1 * | 11/2005 | Zimmermann | 42/75.1 |
| 2007/0028502 | A1 * | 2/2007 | Woodmansee et al. | 42/146 |
| 2011/0061283 | A1 * | 3/2011 | Cavallo et al. | 42/72 |
| 2011/0225865 | A1 * | 9/2011 | Williams | 42/90 |
| 2012/0048104 | A1 * | 3/2012 | Bryant et al. | 89/191.01 |

* cited by examiner

*Primary Examiner* — Samir Abdosh
(74) *Attorney, Agent, or Firm* — Stephen E. Kelly; Rogers Towers, P.A.

(57) ABSTRACT

An improved accessory mount comprising a custom recoil spring guide assembly and a rail sleeve assembly. The custom spring guide assembly comprises a custom recoil spring guide rod having a tip and a shoulder, and a hollow custom recoil spring plug comprising a cylinder and a recessed collar. The rail sleeve assembly comprises a front plate, a sleeve incorporating a integral rails, and an attachment means, such as a retaining hole. A hollow boss having a rim is rigidly connected to the interior face of the front plate, and the front plate is securely connected to the sleeve. To attach the sleeve to the handgun, the tip of the custom rod is inserted into the boss causing the rim to be seated on the shoulder to create a first non-invasive point of fixity. The retaining hole in an extension of the sleeve fits snugly over the slidestop pin extension, thereby creating a second non-invasive point of fixity when the pin is inserted into the hole. The accessories can then be removably attached to the rails by means standard in the industry.

4 Claims, 5 Drawing Sheets

NON-INVASIVE ACCESSORY MOUNT FOR A FIREARM

This application claims the benefit of U.S. Provisional Patent Application Ser. No. 61/335,539, filed on Jan. 8, 2010.

BACKGROUND OF THE INVENTION

In recent years, semi-automatic handguns have become the standard sidearm for law enforcement officers and military personnel. These handguns are often used in close quarters where an assailant has the opportunity for physical contact with the shooter. In these situations, the assailant can strike the muzzle of the handgun, which can position the firearm out of battery and render it inoperable. In the past, strike plates have been used to prevent this result.

In other situations, the shooter may desire to attach various accessories to the firearm, such accessories being flashlights, laser sights, range finders, or the like. Such devices typically attach to handguns via a rail system available in standard sizes, and many models of modern handguns are build with rails manufactured integrally with the gun. However, in recent years, many law enforcement and military personnel desire to retrofit older handgun models with a rail system that permits accessories to be removably attached. Past retrofit rail systems are typically attached to the handgun via invasive means, such as by boring female threads into at least one location of the handgun frame to permit attachment of the rail system by a screw with male threads.

The present invention seeks to overcome these problems by delivering a detachable rail system that can optionally incorporate a strike plate, wherein the rail system is capable of removably attaching to the handgun by non-invasive means.

SUMMARY OF THE INVENTION

The accessory mount generally comprises a custom recoil spring guide assembly and a rail sleeve assembly. The custom spring guide assembly comprises a custom recoil spring guide rod. The guide rod has a tip and a shoulder at its forward end. The plug is a hollow plug comprising a cylinder and a recessed collar. The rail sleeve assembly comprises a front plate, a sleeve incorporating integral rails, and an attachment means. The front plate further comprises an exterior face and an interior face. In one embodiment, hollow boss having a rim is rigidly connected to or integrally manufactured into the interior face, and the front plate is securely connected to the sleeve.

The sleeve has a trough-shaped cross section that overlays the bottom of the dust cover portion of the frame and the slide of the handgun. The rails are integral to the sleeve and comprise a standard configuration to mate with the attachment means commonly included in standard handgun attachments. In one embodiment, the attachment means is a retaining hole in an extension of the sleeve. The hole fits snugly over the slidestop pin extension, thereby creating a point of fixity for the entire sleeve assembly.

To install the rail system, the handgun must be field stripped, and the factory recoil spring guide rod and the factory recoil spring plug are replaced with the custom guide rod and plug, respectively. The handgun is then reassembled and can operate with normal functionality with or without attachment of the sleeve assembly.

To attach the sleeve assembly, the slide of the handgun is pulled partially back and the slidestop is partially slid out of the frame such that the slidestop pin becomes recessed below the opposing exterior surface of the handgun. The sleeve assembly is then positioned at the front of the handgun such that the tip of the guide rod is inserted into the boss, and the rim of the boss is seated on and abuts the shoulder of the guide rod. The sleeve assembly is then maneuvered as needed to snugly fit over the surface of the handgun in a manner positioning the hole over the recessed slidestop pin. When the slidestop is pressed back into its fully inserted position, the end of the slidestop pin moves into the hole to form a snug fit, thus providing a point of fixity for the sleeve assembly. The slide is then returned to its forward position, permitting the collar of the plug to slide over the boss. The handgun is then ready to load and fire with the sleeve assembly in place, with or without accessories attached. In one embodiment of the device, the front plate is a strike plate.

DETAILED DESCRIPTION OF THE INVENTION

With reference to the drawings, the invention will now be described with regard for the best mode and the preferred embodiment. In general, the device is an improved accessory mounting system capable of removably and non-invasively attaching to a semi-automatic handgun. As used herein, the term "non-invasive" means without permanent alteration to the handgun, such as by drilling a hole, bending a member, or otherwise permanently changing the structure of the handgun.

The embodiments disclosed herein are meant for illustration and not limitation of the invention. An ordinary practitioner will understand that it is possible to create many variations of the following embodiments without undue experimentation. For the purposes of illustration, the following discussion will describe how the device attaches to a model M1911 handgun, which is a common semi-automatic handgun. However, an ordinary practitioner will understand that the rail system described herein can be adapted to a wide variety of semi-automatic handguns without undue experimentation. For example, the accessory mount described herein could easily be adapted to fit the Beretta® M9, or a wide variety of other Beretta®, CZ, or Smith and Wesson® semi-automatic handguns.

Figure 1:
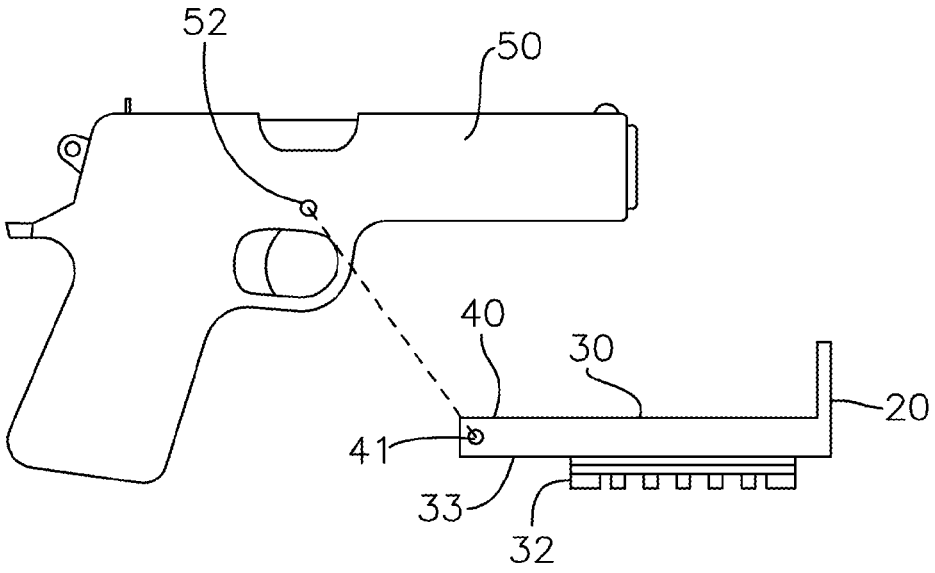
FIG. 1 is a right side view of a typical handgun with the accessory mount shown adjacent to the handgun.
Figure 2:
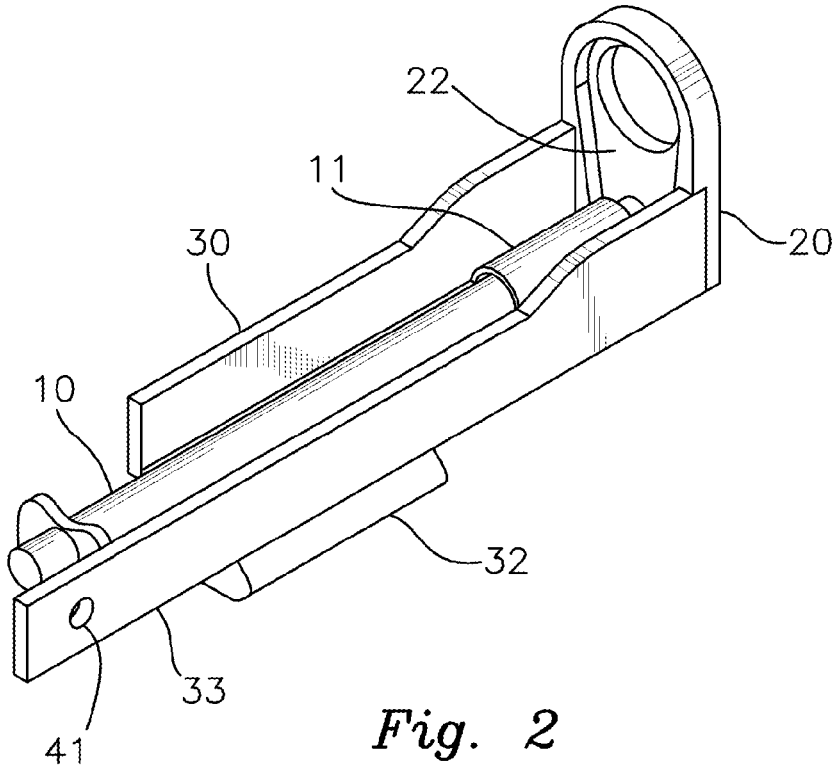
FIG. 2 is an isometric view of the accessory mount.
Figure 6:
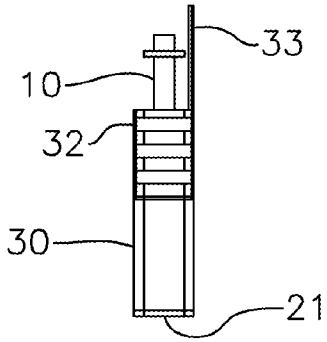
FIG. 6 is a bottom view of the accessory mount.
Figure 3:
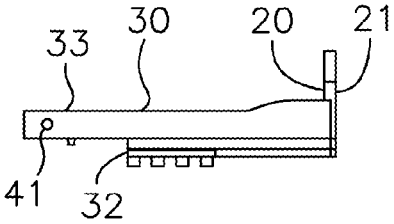
FIG. 3 is a right side view of the accessory mount.
Figure 7:
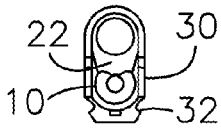
FIG. 7 is a rear view of the accessory mount.
Figure 4:
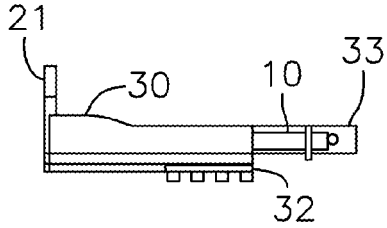
FIG. 4 is a left side view of the accessory mount.
Figure 5:
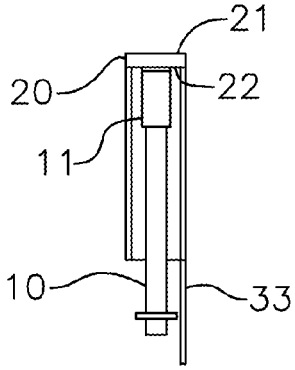
FIG. 5 is a top view of the accessory mount.

The components and operation of the M1911 handgun are well documented, such as on the Internet. For example, a summary of this handgun's history and functionality can be found at http://en.wikipedia.org/wiki/M1911_pistol, which was last accessed on Jan. 7, 2009. Referring to FIG. 1, the commonly known components of the M1911 relevant to this discussion include the recoil spring, the recoil spring guide rod, the recoil spring plug, the slide 50, the slidestop and the slidestop pin 52.

Referring to FIGS. 1-7, the accessory mount generally comprises a rail sleeve assembly that attaches to the recoil spring guide assembly of the handgun. The spring guide assembly comprises a custom recoil spring guide rod 10, and a custom recoil spring plug 11. The custom guide rod 10 has a tip 13 and a shoulder 14 at its forward end. In some applications, it may be desirable to fabricate the custom guide rod 10 from a high-strength metal, such as titanium, grade 7075 aluminum, or the like. The custom plug 11 is a hollow plug comprising a cylinder and a recessed collar 12, as is the case for the hollow plugs commonly installed by manufacturers.

The rail sleeve assembly comprises a front plate 20, a sleeve 30 incorporating rails 32, and an attachment means 40, which is any means for non-invasively attaching the sleeve 30 to the exterior of the handgun, such as an extension arm 33 having a hole 41 for receiving a slidestop pin 52, a detent for removably receiving the tip of the slidestop pin 52, or other equivalent means. In many instances, the attachment means 40 will be attached to the rearward portion of the sleeve assembly.

Figure 8:
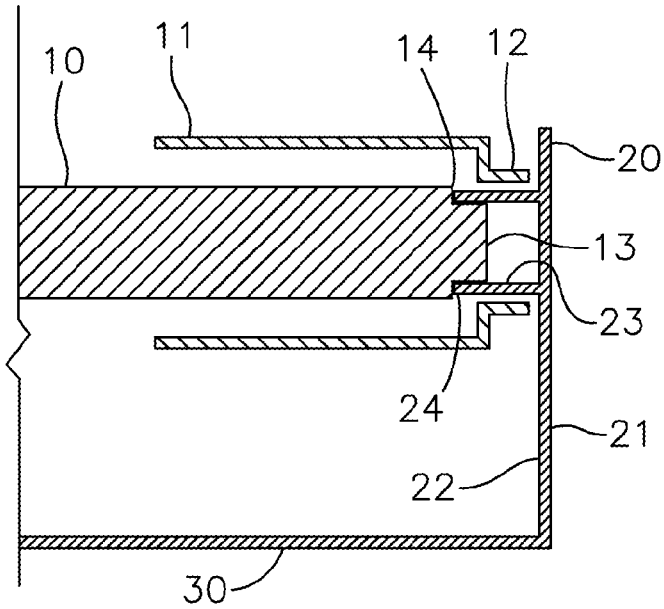
FIG. 8 is a partial cross section of the interface between the custom recoil spring guide assembly and a rail sleeve assembly.

The front plate 20 further comprises an exterior face 21, which faces the target of the projectile fired from the handgun, and an interior face 22 faces the interior of the handgun. Referring to FIG. 8, a hollow boss 23 having a rim 24 is rigidly connected to the interior face 22, and the inside diameter of the rim 24 is slightly larger than the outside diameter of the tip 13 of the custom guide rod 10, thus permitting the tip 13 to be snugly inserted into the boss 23. The front plate 20 is securely connected to the sleeve 30, such as by a weld, an epoxy, or by snug, tight-fitting mechanical tabs. Alternately, the front plate 20 and the sleeve 30 could be integrally manufactured.

The sleeve 30 is made of a durable metal such as steel, aluminum, titanium, or many others which are commonly known in the art. Alternately, the sleeve 30 could be made of a carbon fiber or graphite composite material. The sleeve 30 has a trough-shaped cross section that overlays the bottom portion of the dust cover of the frame and the slide 50 of the handgun. As an ordinary practitioner will understand, the inside surface 31 of the trough can be shaped or milled as desired to fit the exterior contour of various models of the handgun. The rails 32 are integral to the sleeve 30, and the rails 32 comprise a standard configuration to mate with the attachment means commonly included in standard handgun attachments. The attachment means 40 could be an exterior arm 33 attached to the rearward portion of the sleeve 30, the arm 33 having a hole, hook, latch, clasp, or the like. In one embodiment, the attachment means 40 is a retaining hole 41 in an extension member 33 of the sleeve 30. The hole 41 fits snugly over the slidestop pin 52 extension, thereby creating a point of fixity for the entire sleeve assembly.

To install the rail system, the M1911 must be field stripped, instructions for which can be found on many websites, such as http://how-i-did-it.org/detail-1911/field_strip.html, which was last accessed on Jan. 7, 2010. After field stripping the handgun, the factory recoil spring guide rod and the factory recoil spring plug are replaced with the custom guide rod 10 and plug 11, respectively. The handgun is then reassembled and can operate with normal functionality with or without attachment of the sleeve assembly. There is no need to readjust or replace the custom guide rod 10 or plug 11 once they are installed into the handgun. The installation of the custom guide rod 10 and plug 11 require no permanent alterations to the handgun, such as by drilling holes into or bending any of the frame components.

Referring to FIGS. 6-10, the sleeve assembly can be attached to and removed from the handgun with ease. To attach the sleeve assembly, the slide 50 of the handgun is pulled partially back and the slidestop 51 is partially slid out of the frame such that the slidestop pin 52 becomes recessed below the opposing exterior surface of the handgun. The sleeve assembly is then positioned at the front of the handgun such that the tip 13 of the custom guide rod 10 is inserted into the boss 23 causing the rim 24 to be seated on, and abuts against, the shoulder 14 (see FIG. 8). The sleeve assembly is then maneuvered as needed to snugly fit over the surface of the handgun in a manner positioning the hole 41 over the recessed slidestop pin. When the slidestop 51 is pressed back into its fully inserted position, the end of the slidestop pin 51 moves into the hole 41 forming a snug fit, thus providing a point of fixity for the sleeve assembly. The slide 50 is then returned to its forward position, and the handgun is ready to load and fire with the sleeve assembly in place, with or without accessories attached.

In this embodiment, it is preferable that the sleeve 30 fit snugly at the attachment means 40 and the contact point of the collar 12 and the interior face 22. Thus, the sleeve 30 allows only a small tolerance in the distance between the hole 41 and the interior face 22.

As illustrated here, the sleeve assembly is retained by two fixity points, the first being the boss 23 inserted into the plug 11, and the second point of fixity being the slidestop pin 52 inserted into the hole 41 of the attachment means 40. Neither fixity point is invasive or destructive to the handgun, and the handgun needs no permanent alteration to attached and retain the rail system. As an ordinary practitioner will understand, the sleeve assembly can be attached or removed in a matter of seconds without the need to use any tools, such as screwdrivers, pliers, clamps, or the like.

In another embodiment of the mount, the front plate 20 is strike plate that fully covers the front of the handgun. Such strike plates are known in the industry, and some such strike plates have been incorporated into prior rail attachment devices.

Other embodiments of the attachment means 40 include any means for providing a non-invasive point of fixity, such as by a clasp that grips the trigger guard of the handgun. The point of fixity should be such that the sleeve assembly is firmly retained in consistent relation to the handgun so that no slippage occurs during the violent recoil motion. Another embodiment of the attachment means 40 may require the use of a modified or extended slidestop pin 52 permitting the end of the pin 52 to securely engage the attachment means 40. For example, some handgun models comprise a factory slidestop pin 52 that does not sufficiently extend past the exterior surface of the handgun to permit a satisfactory point of fixity. With these handguns, the use of a modified extended pin may be preferable. In another embodiment, the hole 41 in the extension member 33 need not penetrate the full thickness of the extension member 33. Instead, the hole 41 is a recess partially penetrating the thickness of the extension member 33, and the tip of the slidestop pin 52 snugly inserts into the recess to create a satisfactory point of fixity.

In another embodiment, the custom recoil spring guide assembly is used to accommodate alternate dimensions of the handgun. Notably, different manufacturers currently make recoil spring plugs having different collar heights. Since the dimensions of the M1911 are substantially standard for various manufacturers, one of the convenient variables promoting the spacing needed for a consistently snug fit of the sleeve assembly is the height of the collar 12. Thus, in one embodiment of the accessory mount, the height of the collar 12 on a custom plug is sized such that the accessory mount will fit a variety of semi-automatic handguns wherein the respective factory recoil spring plugs originally had varying heights. Another convenient spacing variable is the length of the custom guide rod 10, which will require adjustment depending on the make and model of the handgun. In some embodiments, a custom guide rod 10 with appropriate dimensions can be used to promote a snug attachment of the sleeve assembly to a variety of makes and models of semi-automatic handguns.

Figure 9:
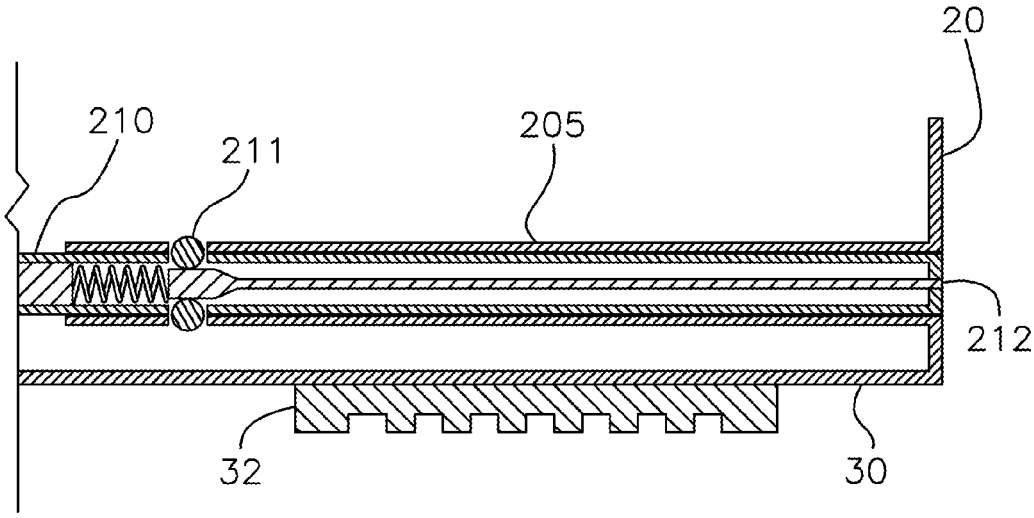
FIG. 9 is a partial cross section showing a front plate with a guide tube and a custom guide rod with a retaining means and an actuating means.

In another embodiment, shown in FIG. 9, the front plate 20 comprises a guide tube 205, and the attachment means 40 comprises a custom guide rod 210 with a retention means 211 and an actuating means 212. The retention means 211 is any means for releasably mating the custom guide rod 210 with the guide tube 205, thereby retaining the rail sleeve assembly to the custom guide rod 210. The retention means 211 could be latches, hooks, clips, detents, bearings, ball and socket attachments, or the like. The actuating means 212 is any means for actuating the retention means 211, such as a pressure release, spring release, or the like. In this embodiment, since the sleeve 30 is retained to the custom guide rod 210 via the guide tube 205, the sleeve 30 is retained to the handgun by one point of fixity without the need for a second point of fixity. The sleeve 30 can be attached to the handgun when the custom guide rod 210 is inserted into the guide tube 205 to permit engagement of the retention means 211. To remove the sleeve 30, the user actuates the actuation means 212, thereby releasing the retention means 211 and permitting removal of the custom guide rod 210 from the guide tube 205.

For example, in the embodiment shown in FIG. 9 the retention means 211 comprises spherical retention members manipulated by a spring driven wedge inside the guide rod 210. The spring drives the wedge forward, thus forcing the spheres to laterally protrude from the guide rod 210. The spheres are capable of protruding into detents or slots in the guide tube 205, thus resisting relative displacement between the guide tube 205 and the guide rod 210. In this embodiment, the actuating means 212 is a rod that extends to the tip of the guide rod 210 such that when the tip of the rod is depressed, the spring compresses and permits the spheres to recede into the guide rod 210, leaving the guide tube 205 unobstructed and free to be removed from the guide rod 210.

The foregoing embodiments are merely representative of the apparatus and not meant for limitation of the invention. For example, one having ordinary skill in the art would understand that the individual features of several disclosed embodiments are adaptable depending on the make and model of the semi-automatic handgun. Consequently, it is understood that equivalents and substitutions for certain elements and components set forth above are part of the invention described herein, and therefore the true scope and definition of the invention is to be as set forth in the following claims.

I claim:

1. A non-invasive accessory mount for a handgun having a slide, said accessory mount comprising:

a sleeve incorporating rails, said sleeve having a forward portion and a rearward portion;

a front plate having an exterior face and an interior face, said front plate attached to the forward portion of the sleeve;

a boss attached to the interior face of the front plate, said boss having a rim;

a custom guide rod having a tip and a shoulder, said tip of the custom guide rod capable of mating with the boss such that the rim of the boss abuts the shoulder of the custom guide rod, thereby securing the forward portion of the sleeve to the handgun; and an attachment means capable of removably attaching at least a portion of the sleeve to the exterior of the handgun;

wherein the attachment means comprises an extension arm having a hole capable of receiving the slidestop pin of the handgun, said extension arm attached to the rearward portion of the sleeve.

2. A non-invasive accessory mount for a handgun having a slide, said accessory mount comprising:

a sleeve incorporating rails, said sleeve having a forward portion and a rearward portion;

a front plate having an exterior face and an interior face, said front plate attached to the forward portion of the sleeve;

a boss attached to the interior face of the front plate, said boss having a rim;

a custom guide rod having a tip and a shoulder, said tip of the custom guide rod capable of mating with the boss such that the rim of the boss abuts the shoulder of the custom guide rod, thereby securing the forward portion of the sleeve to the handgun; and an attachment means capable of removably attaching at least a portion of the sleeve to the exterior of the handgun;

wherein the attachment means comprises an extension arm having a detent capable of receiving the tip of the slidestop pin, said extension arm attached to the rearward portion of the sleeve.

3. The accessory mount of claim 1, wherein the front plate is a strike plate.

4. The accessory mount of claim 2, wherein the front plate is a strike plate.

* * * * *